US008070373B2

(12) United States Patent
Kim

(10) Patent No.: US 8,070,373 B2
(45) Date of Patent: Dec. 6, 2011

(54) DEFORMABLE MASCARA BRUSH

(75) Inventor: HakChan Kim, Gunpo-si (KR)

(73) Assignee: Amorepacific Corporation (KR)

( * ) Notice: Subject to any disclaimer, the term of this patent is extended or adjusted under 35 U.S.C. 154(b) by 427 days.

(21) Appl. No.: 12/278,757

(22) PCT Filed: Apr. 2, 2007

(86) PCT No.: PCT/KR2007/001595

§ 371 (c)(1),
(2), (4) Date: Aug. 7, 2008

(87) PCT Pub. No.: WO2007/117091

PCT Pub. Date: Oct. 18, 2007

(65) Prior Publication Data

US 2010/0200013 A1 Aug. 12, 2010

(30) Foreign Application Priority Data

Apr. 10, 2006 (KR) ..... 20-2006-0009541 U

(51) Int. Cl.
*A46B 11/00* (2006.01)

(52) U.S. Cl. ..... 401/129; 401/127; 401/126

(58) Field of Classification Search ..... 401/9, 11, 401/126, 127, 129; 132/317
See application file for complete search history.

(56) References Cited

U.S. PATENT DOCUMENTS 4,869,612 A * 9/1989 Mooney et al. ..... 401/130
5,137,038 A * 8/1992 Kingsford ..... 132/218
7,172,357 B2 * 2/2007 Gueret ..... 401/129
7,467,905 B2 * 12/2008 Habatjou ..... 401/127

* cited by examiner

*Primary Examiner* — David Walczak
(74) *Attorney, Agent, or Firm* — John K. Park; Park Law Firm

(57) ABSTRACT

The mascara brush including a brush stick which is provided in a cap; a brush which is provided at the end of the brush stick; and an elevating bar which is connected to the brush stick in the manner of screw. The brush gets straightened to make eyelash voluminous when the elevating bar is elevated down and the brush gets curved to make eyelash curled when the elevating bar is elevated up.

3 Claims, 3 Drawing Sheets

[Fig. 1]
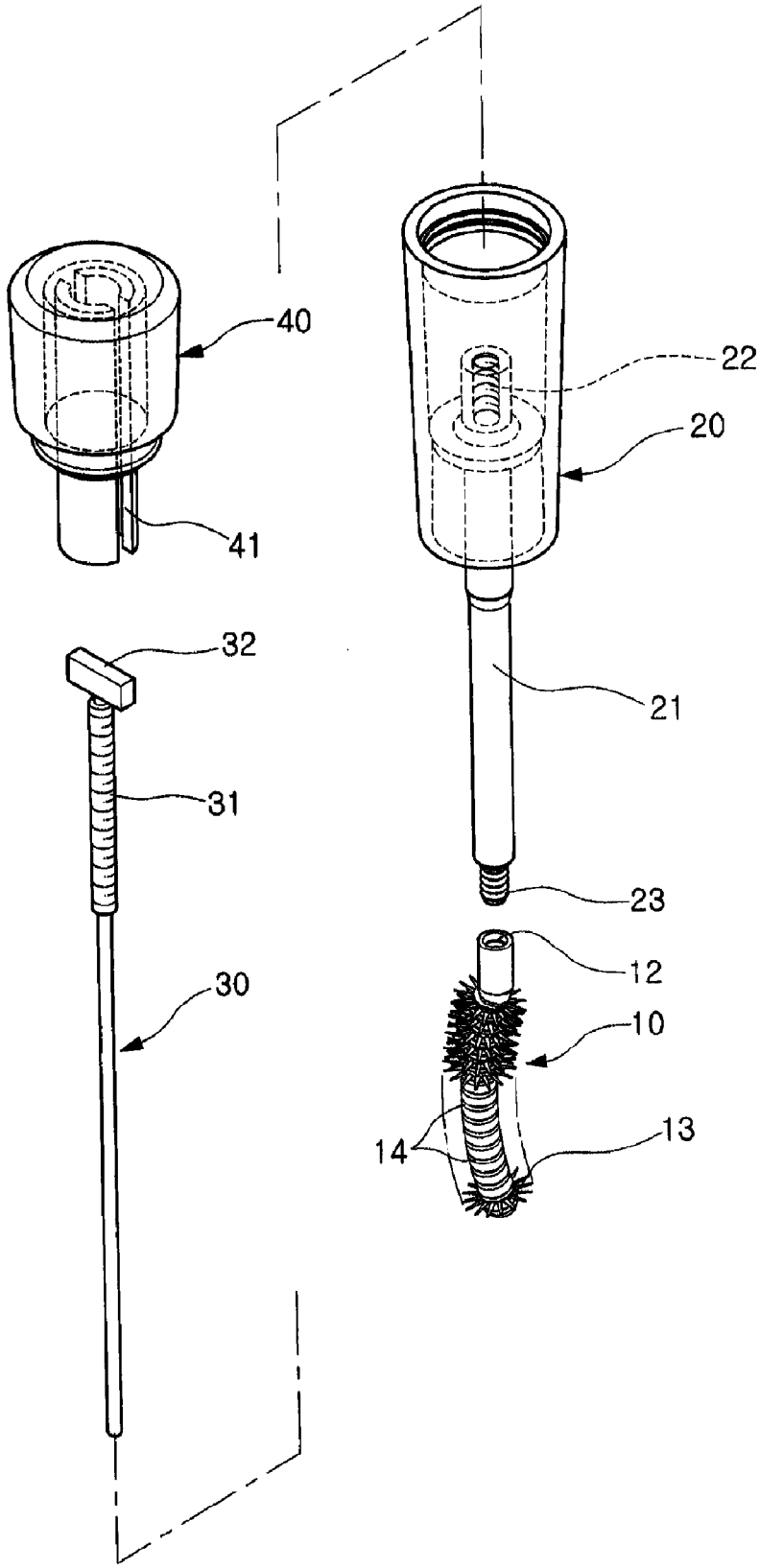

[Fig. 2]
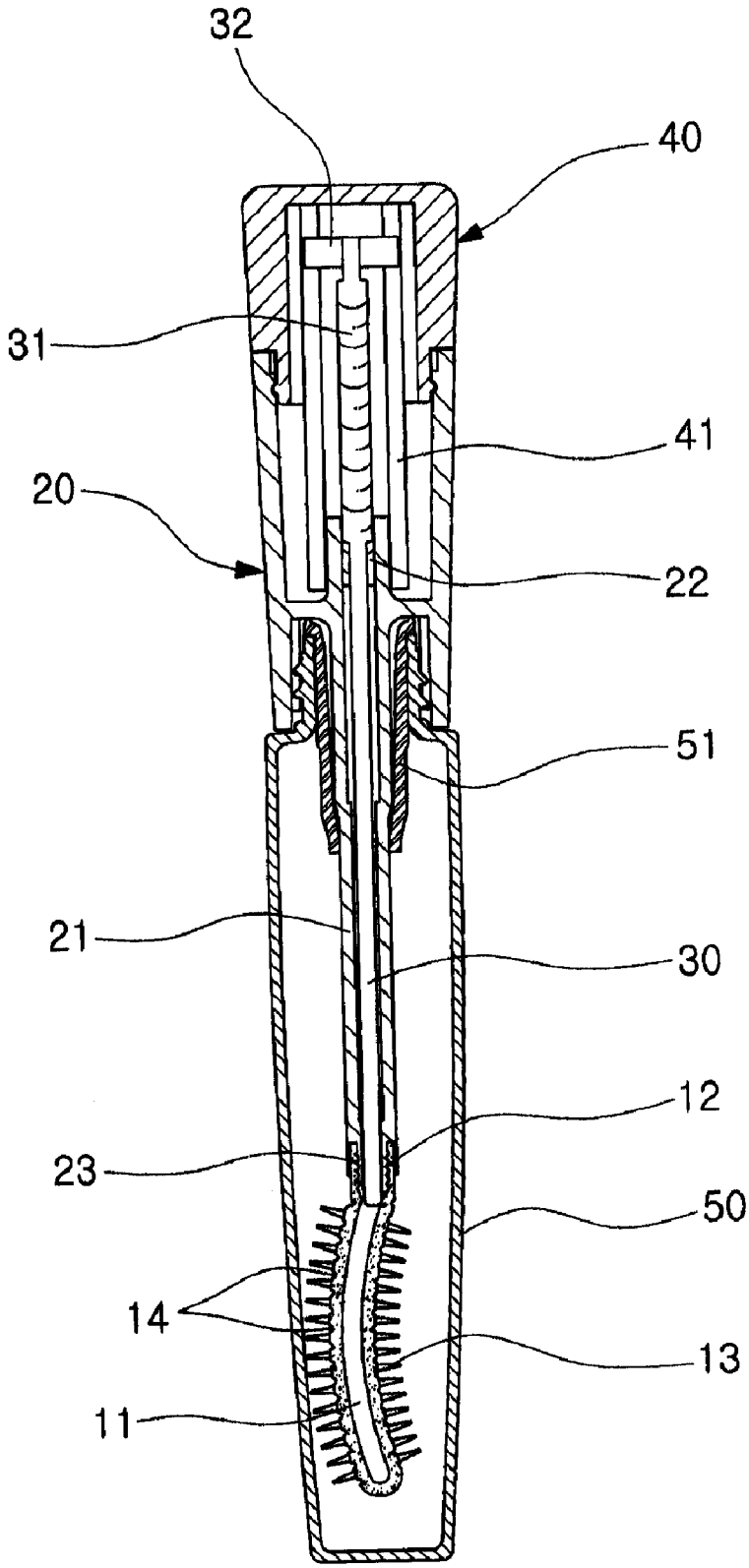

[Fig. 3]
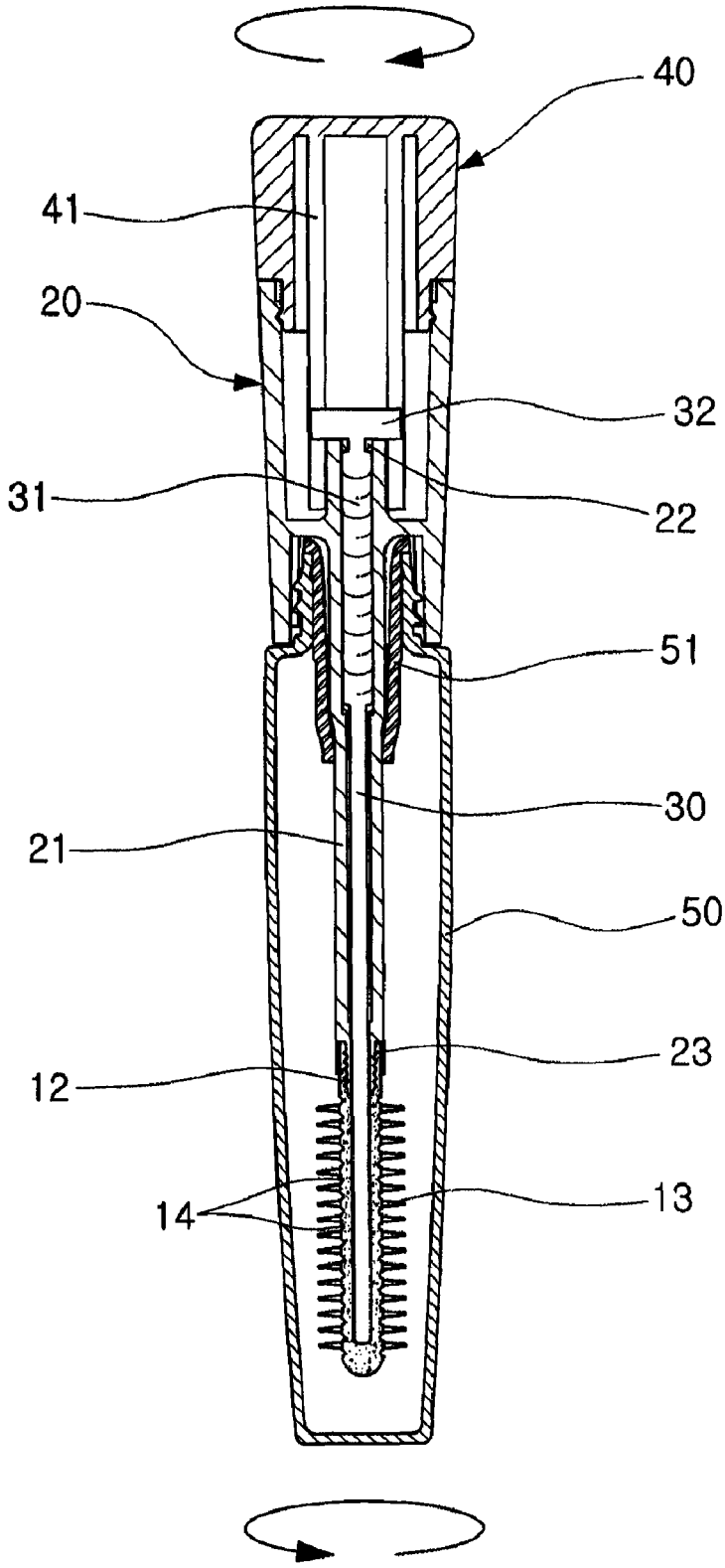

DEFORMABLE MASCARA BRUSH

TECHNICAL FIELD

The present invention relates to an mascara brush for makeup of eyelash, and more particularly, to a mascara brush of which the form of the brush, which is used to apply mascara solution to eyelash, can be reformed suitably according to cases for example, when it is used to make eyelash voluminous or when it is used to make eyelash curled, thereby a problem to equip various brushes for every function can be solved, an economic burden of user can be reduced and makeup can be performed clearly and beautifully by using only a mascara brush.

BACKGROUND ART

To makeup eyelash is to make eyelash beautiful so that appearance can be looked best. Makeup of eyelash is performed by using a mascara brush.

When makeup of eyelash is performed, mascara solution is applied to eyelash evenly while eyelash is combed up by the mascara brush with mascara solution.

Makeup of eyelash can be performed well by curling eyelash after mascara solution is applied thereon.

Generally, not only to makeup eyelash voluminous but also to curl eyelash, only a single mascara brush is used. Thus, makeup of eyelash cannot be performed well. Particularly, curling of eyelash cannot be done. The reason is that a bar type mascara brush is widely used currently.

When makeup of eyelash is performed by using the bar type mascara brush, the brush must be moved along the line of eyelash sequentially because the brush can be contacted to eyelash partially that is, it cannot be contacted fully.

When makeup of eyelash is performed with the mascara brush moved sequentially, not only much time must be required to makeup eyelash but also good makeup could not be achieved because eyelash cannot be curled evenly.

Accordingly, a special mascara brush, which is made to curl eyelash evenly, may be used. Because the line of brush string of the special mascara brush is curved in accordance with the line of eyelash, the aforementioned problem of the bar type mascara brush can be solve.

Despite of the curved mascara brush, general user uses the bar type mascara brush because there is economic burden to equip various mascara brushes and there is a problem to change brushes when makeup of eyelash.

Thus it is necessary to provide a solution in which not only to makeup eyelash voluminous but also to curl eyelash can be performed with a single mascara brush.

DISCLOSURE OF INVENTION

Technical Problem

An object of the present invention is to provide a mascara brush which can be reformed suitably according to the case when it is used to make eyelash voluminous or when it is used to make eyelash curled, so that economic burden of user to equip different mascara brush for each function can be reduced and makeup of eyelash can be performed clearly and well.

Technical Solution

A mascara brush according to the present includes

A brush stick which is provided in a cap;

a brush which is provided at the end of the brush stick;

An elevating bar which is connected to the brush stick in the manner of screw, wherein the brush gets straightened so that it is suitable to make eyelash voluminous when the elevating bar is elevated down and the brush gets curved so that it is suitable to make eyelash curled when the elevating bar is elevated up.

ADVANTAGEOUS EFFECTS

The mascara brush according to the present invention is reformed to be straightened or to be curved selectively according to the movement of the elevating bar 30, which is inserted to the brush stick 21 of the cap 20 and screwed to a screwed hole 22 of the brush stick 30, so that a problem to equip different mascara brush for each function, economic burden of user can be reduced, and makeup of eyelash can be performed clearly and well.

BRIEF DESCRIPTION OF THE DRAWINGS

The above and other features and advantages of the present invention will become more apparent by describing in detail preferred embodiments thereof with reference to the attached drawings in which:

FIG. 1 is a partial perspective view illustrating the mascara brush according to the present invention;

FIG. 2 is a perspective view illustrating an exemplary mascara brush according to the present invention; and FIG. 3 is a perspective view illustrating another exemplary mascara brush according to the present invention.

BRIEF DESCRIPTION OF NUMERALS IN DRAWINGS

10 . . . brush 11 . . . guiding hole
13 . . . brush string 20 . . . cap
21 . . . brush stick 22 . . . screwed hole
30 . . . elevating bar 31 . . . thread of screw
32 . . . districting piece 40 . . . adjusting knob
41 . . . districting and guiding hole 50 . . . container body

MODE FOR THE INVENTION

Reference will now be made in detail to the embodiments of the present invention, examples of which are illustrated in the accompanying drawings, wherein like reference numerals refer to the like elements throughout. The embodiments are described below to explain the present invention by referring to the figures. For the sake of clearness and concision, technology related to the present invention that is not novel and is well known in the art to which present invention pertains will not be described herein.

As shown in FIGS. 1 through 3, a mascara brush according to the present invention comprises of a container body 50, where mascara solution is contained, and a cap 20 including a tube type brush stick 21, a brush 10 which is assembled to the brush stick 21, an elevating bar 30 which is provided at the upper portion of the cap 20 and elevated by an adjusting knob 40 to reform the line of the brush 10 selectively.

A blade 51, which is provided at the opening portion of the container body 50, allows that mascara solution of an appropriate amount is remained at the mascara brush 10 by brushing the brush 10.

The tube type brush stick 21 is provided in the cap 20 which is installed at the top of the container body 50. A screwed hole 22, where a thread of screw is formed along its inner side, is provided at the upper and inner circumference of the brush stick 21. A thread of screw 23 is provided for screwing the brush 10 at the lower and outer circumference of the brush stick 21.

The brush 10 is screwed to connect to the lower portion of the brush stick 21. A guiding hole 11 to guide the elevating bar 30 is provided at the center of the brush 10. A thread of screw 12 is provided at the upper and inner circumference of the brush 10 to connect to the thread of screw 23 of the brush stick 21. Brush string 13 is provided on the outer circumference of the brush 10.

It should be noted that not only a screw type connection bur also a connection by heat, a connection to use an adhesive and a connection to use under-cut can be used to connect the brush 10 to the brush stick 21.

A ring-shaped groove 14 is provided along the circumference of the brush 10 so that the reformation between brush strings 13 can be done well. The basic form of the brush 10 is straight.

The brush 10 is made by a elastic material such as silicon rubber.

A thread of screw 31 is provided at the elevating bar 30. The elevating bar 30 is inserted at the upper portion of the cap 40 and screwed to connect to the screwed hole 22 at the upper portion of the brush stick 21. A restricting piece 32 which is located to the restricting and guiding hole 41 of the adjusting knob 40 is provided at the upper portion of the elevating bar 30.

A restricting and guiding hole 41, where the restricting piece 32 of the elevating bar 30 is guided and restricted, is provided at the adjusting knob 40, which is provided at the top of the cap 20 rotatably.

The thread of screw 12, which is formed at the upper and inner circumference of the brush 10, is screwed to connect to the thread of screw 23, which is formed at the lower portion of the brush stick 21 of the cap 20.

The elevating bar 30 is inserted to the brush stick 21 where the brush 10 is assembled.

When the elevating bar 30 is installed to the brush stick 21, the thread of screw 31 of the elevating bar 30 is screwed to connect to the screwed hole 22, which is provided at the upper and inner circumference of the brush stick 21 after the elevating bar 30 is inserted from the top of the cap 20.

After the elevating bar 30 is installed completely, the adjusting knob 40 is installed to the cap 20 while the restricting piece 32 of the elevating bar 30 is located at the restricting and guiding hole 41.

Makeup of eyelash is performed by using the mascara brush which is assembled as aforementioned.

Mascara solution is applied to eyelash while the brush 10 is straightened as shown in FIG. 3 at the beginning of makeup of eyelash.

To make the brush 10 straightened, the adjusting knob 40 is rotated as noted by the arrow in FIG. 3.

When the adjusting knob 40 is rotated to the direction of the arrow, the elevating bar 30 is moved down while the thread 31 of the elevating 30 is guided along the screwed hole 22 of the brush stick 21 in accordance with the movement of the restricting piece 31, which is inserted at the restricting and guiding hole 41 of the adjusting knob 40.

When the elevating bar 30 is inserted into the guiding hole 11 of the brush 10, the brush gets straightened. Mascara solution can be applied to the eyelash with the brush 10 straightened as described above.

Because the ring shaped groove 14 is provided between the brush strings 13 of the brush 10, reformation of the brush 10 can be done easily.

After applying mascara solution with the brush 10 straightened, eyelash is curled to achieve more beautiful eyelash.

The eyelash is curled while the brush 10 is curved as shown in FIG. 2.

To make the brush 10 curved, the adjusting knob 40 is rotated reversely so that the elevating bar 30, which was inserted into the guiding hole 11 of the brush 10, is escaped.

The elevating bar 30 can be escaped from the guiding hole 11 of the brush 10 because the restricting piece 32 of the elevating bar 30 is guided to elevate down to the restricting and guiding hole 41 of the adjusting knob 40 as the thread of screw 31 of the elevating bar 30 is screwed reversely from the screwed hole 22 of the brush stick 21.

When the brush 10 is escaped from the guiding hole 11 with the elevating bar 30 elevated up by the operation of the adjusting knob 40, the brush 10 is curved to the original form.

Because the brush 10 is curved to be suitable to the curve of the eyelash, the brush 10 can be contacted to whole of eyelash so that eyelash can be curled evenly.

As described above, more beautiful and sensitive makeup of eyelash can be achieved by using the mascara brush according to the present invention.

INDUSTRIAL APPLICABILITY

The mascara brush according to the present invention can be reformed suitably according to the case when it is used to make eyelash voluminous or when it is used to make eyelash curled, so that economic burden of user to equip different mascara brush for each function can be reduced and makeup of eyelash can be performed clearly and well.

The invention claimed is:

1. A mascara brush suitable to comb up eyelash, the mascara brush comprising:

a brush 10 provided at the end of a brush stick 21;

an elevating bar 30 provided in the brush stick 21 and possible to move upwardly or downwardly;

a container body 50 where mascara solution is contained;

a blade 51 provided at the opening portion of the container body 50;

a cap 20 including the brush stick 21 where the brush 10 is provided and the elevating bar 30 is connected; and an adjusting knob 40 provided at the cap 20 and possible to rotate;

wherein the brush 10 gets straightened or curved in accordance with the movement of the elevating bar 30 and the blade 51 allows that mascara solution of an appropriate amount is remained at the mascara brush 10 by brushing the brush 10, wherein a guiding hole 11, to which the elevating bar 30 can be inserted selectively, is provided in the brush 10 and a brush string 13 is provided on the outer circumference of the brush 10; a thread of screw 31 of the elevating bar 30, which is adapted to be rotationally engaged with a screwed hole 22, which is provided at the upper and inner circumference of the brush stick 21, and a restricting piece 32, which is restricted by the adjusting knob 40, are provided at the upper portion of the elevating bar 30; and a restricting and guiding hole 41, by which the restricting piece 32 of the elevating bar 30 is restricted and guided, is provided in the adjusting knob 40, and wherein the restricting piece 32 fits into the restricting and guiding hole 41 so that the restricting piece can move up and down along the restricting and guiding hole.

2. The mascara brush in claim 1, wherein the mascara brush 10 is made of silicon rubber.

3. The mascara brush in claim 1, further comprising;

a ring-shaped groove 14 provided between brush strings to ease the change of the form of the brush 10.

* * * * *